United States Patent [19]

Sakano et al.

[11] 4,404,763

[45] Sep. 20, 1983

[54] ROTARY SNOW PLOUGH

[75] Inventors: Takashi Sakano; Mikio Igarashi, both of Niigata, Japan

[73] Assignee: Niigata Engineering Co., Ltd., Tokyo, Japan

[21] Appl. No.: 324,937

[22] Filed: Nov. 25, 1981

Related U.S. Application Data

[63] Continuation of Ser. No. 140,540, Apr. 15, 1980, abandoned.

[51] Int. Cl.[3] ..... E01H 5/09

[52] U.S. Cl. ..... 37/250; 37/248

[58] Field of Search ..... 37/247, 248, 250, 251

[56] References Cited

U.S. PATENT DOCUMENTS

| | | | |
|---|---|---|---|
| 1,508,716 | 9/1924 | Ochs | 37/250 |
| 1,701,767 | 2/1929 | Barry | 37/251 |
| 2,166,667 | 7/1939 | Watkins | 37/248 X |
| 2,583,608 | 1/1952 | Smith | 37/250 |
| 2,719,368 | 10/1955 | Snook | 37/250 |
| 4,346,527 | 8/1982 | Schmidt | 37/251 |

FOREIGN PATENT DOCUMENTS

| | | | |
|---|---|---|---|
| 596760 | 4/1960 | Canada | 37/251 |
| 59501 | 2/1942 | Denmark | 37/251 |
| 1155462 | 10/1963 | Fed. Rep. of Germany | 37/248 |
| 1806715 | 5/1970 | Fed. Rep. of Germany | 37/248 |

*Primary Examiner*—E. H. Eickholt

*Attorney, Agent, or Firm*—Sughrue, Mion, Zinn, Macpeak and Seas

[57] ABSTRACT

A rotary snow plough vehicle having an auxiliary auger pivotable along a vertical plane perpendicular to the advancing direction of the vehicle. The auxiliary auger is rotatably secured about its axis by a supporting arm through bearings. Said supporting arm is positioned above a main auger and is swingable about a central shaft extending in parallel with the advancing direction of the vehicle. A tiltable cylinder is pivotably disposed between a frame and the supporting arm. By the extension and retraction of a piston rod of the cylinder, the supporting arm together with the auxiliary auger are swingably movable about the central shaft. The central shaft is extended from a deceleration means adapted to transmit the rotation of the main auger to the auxiliary auger. The auxiliary auger can be further provided with an extension auger in alignment therewith.

9 Claims, 4 Drawing Figures

ROTARY SNOW PLOUGH

This is a Continuation of application Ser. No. 140,540, filed Apr. 15, 1980 and now abandoned.

BACKGROUND OF THE INVENTION

The present invention relates to a rotary snow plough, and more particularly, to an improvement of a device for cutting through a snow bank and introducing the snow into a snow blower for use in a rotary snow plough.

In the snow-removing work, particularly for clearing a high snow bank, the conventional motor grader or bulldozer cuts through the snow bank toward a road surface, and thereafter, the levelled snow is blown by the conventional rotary snow plough. Therefore, the workability is insufficient since the snow levelling work is conducted independent of the snow blowing work.

In this regard, the same assignee has developed a rotary snow plough capable of providing high workability for snow removing work, as disclosed in a publication of Japanese Utility Model No. Sho-48-5228(1973). According to the snow plough, an auxiliary auger is fixedly and horizontally disposed above a main auger, and a chain saw in fixedly and vertically disposed beside the auxiliary auger. In addition, a backing plate is disposed at a rear side of the auxiliary auger and the chain saw. With this structure, the snow bank portion at the level higher than the main auger is subject to vertical and horizontal cutting by the chain saw and the auxiliary auger, respectively, and the backing plate bulldozes the rifted snow bank.

This type of rotary snow plough does provide several advantages. However, since this plough is adapted to provide vertical rift in the snow bank, by the chain saw having relatively small vertical length, desirable vertical cutting may not be carried out if the height of the snow bank is very high so that sufficient snow removing work may not be conducted. Further, since the chain saw and the backing plate is vertically extended in front of the operator's room, it is difficult to provide a large range of vision for the operator, so that it is dangerous to run the snow plough in out-of-use state.

SUMMARY OF THE INVENTION

It is therefore an object of the present invention to overcome the above-mentioned drawbacks and to provide an improved device for snow removing work.

Another object to this invention is to provide a device capable of removing a high snow bank.

Still another object of this invention is to provide a snow plough capable of providing wide field of vision during operable and out-of-use states thereof.

These and other objects are attained in accordance with the present invention by providing an auxiliary auger above a main auger. The auxiliary auger is swingably disposed along a vertical plane perpendicular to the advancing direction of the snow plough. The auxiliary auger is swingably disposed via a supporting arm about a shaft of a deceleration means. The supporting arm is connected to a tiltable cylinder adapted to pivot the auxiliary auger about the shaft. The rotation of the main auger is transmitted to the auxiliary auger through the shaft. Furthermore an extension auger is coaxially connectable to the auxiliary auger to remove high snow banks. During non-operable conditions the auxiliary and extension augers are horizontally maintained, while during operable conditions, these augers are swung or maintained at upstanding or slanting position in response to the expansion or retraction of the cylinder rod of the tiltable cylinder.

DETAILED DESCRIPTION OF THE INVENTION

Figure 1:
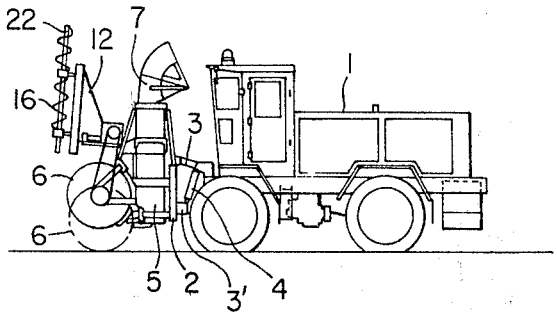
FIG. 1 is a side view of a rotary snow plough according to the present invention.

Referring now to the drawings, and initially to FIG. 1, a frame 2 for mounting a snow plough is disposed in front of a vehicle body 1 and is connected thereto by a pair of links 3, 3' extending parallel with each other. Another pair of links are disposed at the opposite side of the links 3, 3'. The frame 2 is vertically movable by a pair of hydraulic cylinders 4. A blower 5 is mounted on the frame 2 for throwing the snow away from the road, and a main auger 6 is mounted on the frame 2 for cutting through the snow bank and scratching up the snow. The main auger 6 is positioned in front of the blower 5 to scratch up the snow and to introduce the scratched snow into the blower 5. The blower 5 is adapted to throw the scratched snow away from the vehicle through a chute 7.

Figure 2:
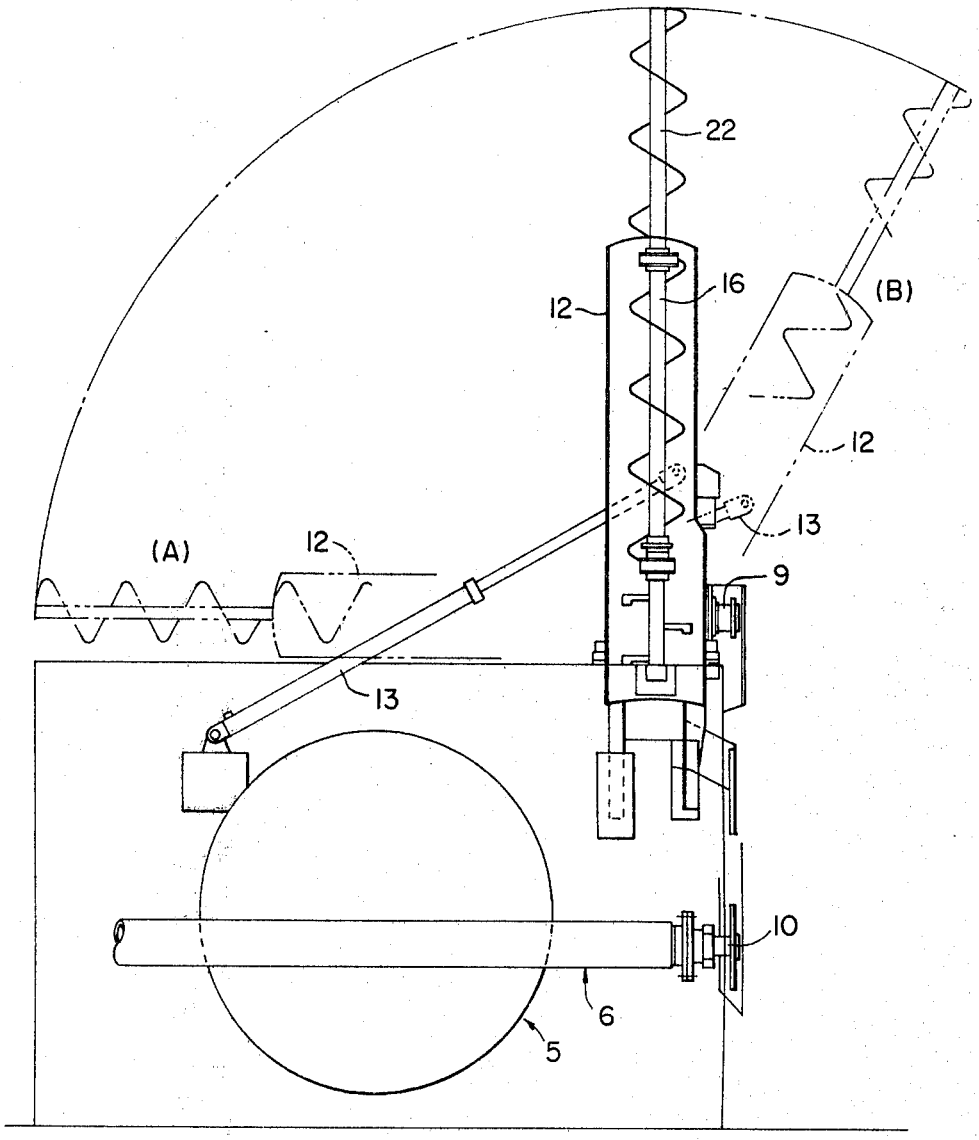
FIG. 2 is a front view showing an auxiliary auger according to the present invention.
Figure 3:
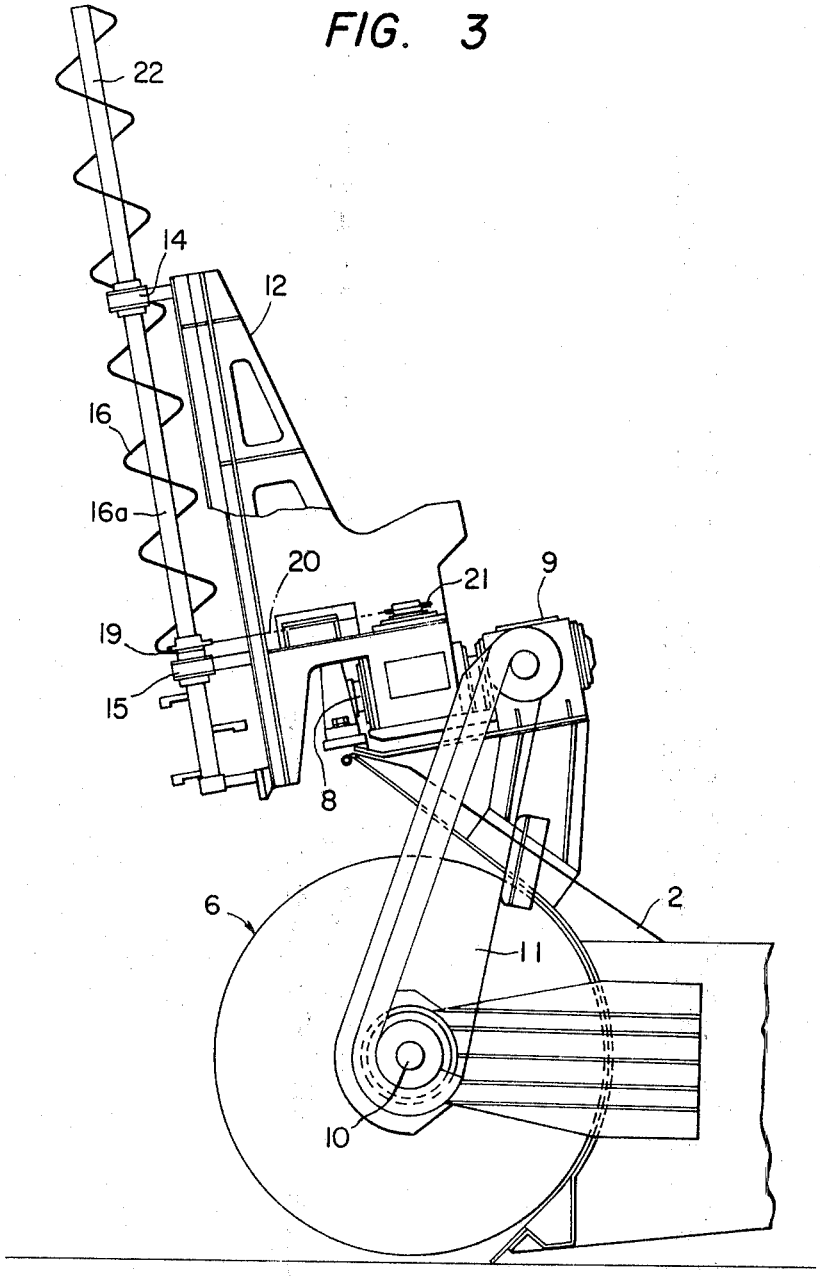
FIG. 3 is a side view showing the auxiliary auger according to the present invention.

As shown in FIGS. 2 and 3, the snow plough is provided with a deceleration means 9 whose shaft 8 is substantially horizontally extended toward the advancing direction of the vehicle body 1. The deceleration means 9 is connected to a rotary shaft 10 of the main auger 6 through a transmission member 11 such as a chain. Further, a supporting arm 12 for rotatably supporting an auxiliary auger 16 is swingably provided about the shaft 8. The supporting arm 12 is swingable in a vertical plane perpendicular to the advancing direction of the vehicle body 1. Furthermore, a tiltable cylinder 13 is pivotably disposed between the frame 2 and the supporting arm 12 in order to control the inclination angle of the arm 12.

The supporting arm 12 is provided with bearings 14, 15 at its front end (FIG. 3) in order to rotatably support a rotary shaft 16*a* of the auxiliary auger 16, at the position above the main auger 6. Further, an extension auger 22 is detachably connected to the upper end of the auxiliary auger 16.

Figure 4:
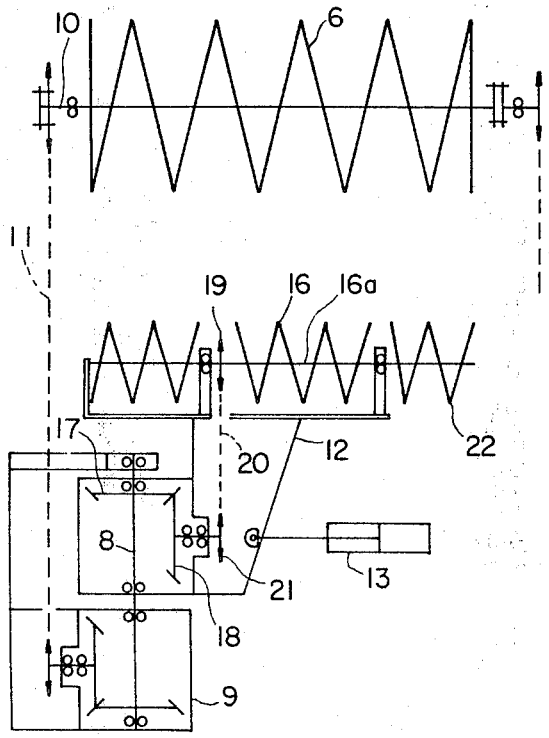
FIG. 4 is a schematic illustration showing a driving system of the main and auxiliary augers according to the present invention.

The rotary shaft 10 of the main auger 6 is rotated together with the rotation of the blower 5 by a driving means (not shown) such as an internal combustion engine. As shown in FIG. 4, the rotation of the shaft 10 is transmitted to the shaft 8 of the deceleration means 9 through the chain 11. The shaft 8 is coaxially provided with a bevel gear 17 which is in meshing engagement with a bevel gear 18. The bevel gear 18 is integrally and coaxially provided with a sprocket wheel 21. The rotary shaft 16*a* of the auxiliary auger 16 is coaxially provided with a sprocket wheel 19, and a chain 20 is trained over the sprocket wheels 19 and 21. Therefore the rotation of the rotary shaft 10 of the main auger 6 is transmitted to the rotary shaft 16*a* of the auxiliary auger 16 through chain 11, shaft 8, bevel gears 17, 18 sprocket wheels 21, 19 and chain 20.

In operation, in case the snow height is lower or slightly higher than that of the main auger 6, the cylinder rod of the tiltable cylinder 13 is retracted to swing the auxiliary auger 16 about the shaft 8 so as to horizontally position the same as shown by (A) in FIG. 2. Therefore, snow removing operation is achieved by the main auger 6 and the blower 5 as is done in the conventional snow plough. In this case, the auxiliary and extension augers 16 and 22 are rotated about their axes in their horizontal positions. Therefore, if the snow height is at the level approximately equal to the horizontal position of the auxiliary and extension augers, such snow is fallen down by the rotation of these augers.

On the other hand, when the snow height is extremely large, the cylinder rod of the tiltable cylinder 13 is reciprocated to cyclically swing the supporting arm 12 about the shaft 8. Therefore, the auxiliary auger 16 and the extension auger 22 are swung over the maximum swingable range shown from position A to B in FIG. 2. Since the bevel gears 17, 18 are always engaged with each other regardless of the swinging position of the supporting arm 12, the auxiliary and extension augers 16,22 are rotated in response to the operation of the main auger 6 and the blower 5. As a result, the snow positioned above the main auger 6 is levelled and directed toward the main auger 6 by the auxiliary and extension augers. Theoretically, the snow range to be removed by the auxiliary and extension augers is within the semi-circular range as shown, for example, by a chain line in FIG. 2, coincident with the swing range of these augers. However, since a large snow cave is generated because of the swinging movement of the auxiliary and extension augers, the snow cave collapses due to the weight of the snow existing above the cave, so that the snow exsisting above the highest position of the auger can also be introduced into the blower.

Incidentally, augers 16 and 22 may be stationarily maintained at their upstanding or inclining positions in order to obtain optimum efficiency, taking the snow condition and snow-falling state into consideration. Further, if the snow height is far beyond the tip end of the extension auger 22, the auger 22 can be replaced by a different extension auger having a larger axial length than the former auger. During the non-service state of the snow plough for mere running thereof, the main auger 6 is moved at its ascent position by the operation of the hydraulic cylinders 4 (FIG. 1), and the augers 16 and 22 are horizontally positioned together with the supporting arm 12, so that wide field of vision is provided for easy and safty running.

According to the embodiment mentioned the above, auxiliary auger 16 is rotated by the driving power transmitted from the main auger 6. However, it is possible to obtain the driving power from another device. Further, the auxiliary auger 16 can be driven independent of the main auger 6 by employing separate driving means such as an internal combustion engine and a hydraulic motor. Furthermore, according to the foregoing embodiment, the supporting arm 12 is swingable by the employment of the tiltable cylinder 13. However, another kind of means can be employable instead of the cylindr 13.

While the invention has been described in detail and with reference to a specific embodiment thereof, it will be apparent to one skilled in the art that various changes and modifications can be made thereto without departing from the spirit and scope of the invention.

What is claimed is:

1. A rotary snow plough vehicle including a frame positioned in front of said vehicle, and a main auger supported to said frame and adapted to level a snow bank and introduce the same into a blower, comprising:

(a) an auxiliary auger swingably mounted above said main auger, a swingable range of said auxiliary auger being from a horizontal position approximately above said main auger to a position laterally outside of said vehicle;

(b) means for swingably moving said auxiliary auger along a vertical plane perpendicular to an advancing direction of said vehicle in order to level an upper section of said snow bank;

(c) transmission means for transmitting rotation of said main auger to said auxiliary auger to rotate said auxiliary auger about its axis, said transmission means comprising a deceleration means disposed on said frame, said deceleration means having a central shaft extending toward the advancing direction of said vehicle, said supporting arm being swingable about said central shaft;

(d) an endless chain trained between said main auger and said deceleration means;

(e) a first bevel gear integrally and coaxially secured to said central shaft;

(f) a second bevel gear in meshing engagement with said first bevel gear;

(g) a first sprocket wheel provided coaxial and integral with said second bevel gear;

(h) a second sprocket wheel provided coaxial and integral with said auxiliary auger; and (i) an endless chain trained over said first and second sprocket wheels.

2. A rotary snow plough vehicle including a frame positioned in front of said vehicle, and a main auger supported by said frame for leveling a snow bank and introduce the same into a blower, comprising:

(a) a supporting arm having one end pivotally supported to an upper lateral end portion of said frame, an opposite end of said supporting arm being free;

(b) means for swingably mounting said supporting arm to said upper lateral end portion of said frame so that said supporting arm is swingable in a plane oriented substantially perpendicular to a vehicle advancing direction;

(c) an auxiliary auger supported by and along said supporting arm, said auxiliary auger having a rotation shaft rotatably supported by said supporting arm, said rotation shaft being swingable above said main auger in a sector plane oriented substantially perpendicular to said advancing direction of said vehicle, a swingable range of said rotation shaft extending from a horizontal position approximately above said main auger to a position laterally outside said upper lateral end portion whereat said free end of said supporting arm is positioned laterally outside said lateral end portion;

(d) drive means for rotating said auxiliary auger about its axis; and (e) means for moving said supporting arm to swing said auxiliary auger within said swingable range.

3. The rotary snow plough vehicle as claimed in claim 1, further comprising an extension auger detachably provided in alignment with said auxiliary auger.

4. The rotary snow plough vehicle as claimed in claim 2, wherein said moving means comprises a tiltable cylinder having one end connected to said frame and the other end to said free end of said supporting arm.

5. The rotary snow plough vehicle as claimed in claim 1, wherein said drive means comprises a power transmission means adapted to transmit rotation of said main auger to said auxiliary auger.

6. The rotary snow plough vehicle as claimed in claim 5, wherein said power transmission means comprises:

(a) rotation means disposed on said frame, said rotation means having a central shaft extending toward said advancing direction of said vehicle, said supporting arm being swingable about said central shaft;

(b) first transmission means connected between said main auger and said central shaft to rotate said central shaft;

(c) second transmission means disposed on said supporting arm to output rotation of said central shaft; and (d) third transmission means adapted to transmit output of said second transmission means to said auxiliary auger.

7. The rotary snow plough vehicle as claimed in claim 6, wherein said first transmission means comprises an endless chain trained between said main auger and said rotation means.

8. The rotary snow plough vehicle as claimed in claim 6, wherein said second transmission means comprises a first bevel gear integrally and coaxially secured to aid central shaft, and a second bevel gear in meshing engagement with said first bevel gear.

9. The rotary snow plough vehicle as claimed in claim 6, wherein said third transmission means comprises a first sprocket wheel provided coaxial and integral with said second bevel gear, a second sprocket wheel provided coaxial and integral with said auxiliary auger, and an endless chain trained over said first and second sprocket wheels.

* * * * *